United States Patent [19]

Holmgren

[11] 4,047,412

[45] Sept. 13, 1977

[54] METHOD OF MAKING A PIPE FITTING AND PRODUCT

[75] Inventor: Marvin E. Holmgren, Elkhart, Ind.

[73] Assignee: Elkhart Products Corporation, Elkhart, Ind.

[21] Appl. No.: 741,968

[22] Filed: Nov. 15, 1976

[51] Int. Cl.[2] ..... B21D 51/16

[52] U.S. Cl. ..... 72/58; 29/157.6

[58] Field of Search ..... 72/57, 58, 60, 61, 59; 29/157 R, 157.6

[56] References Cited

U.S. PATENT DOCUMENTS

| | | | |
|---|---|---|---|
| 1,947,611 | 2/1934 | Miothe | 72/58 |
| 2,858,787 | 11/1958 | Hill | 72/58 |
| 3,220,098 | 11/1968 | Arbogast | 29/157 R |
| 3,225,423 | 12/1965 | Huet | 29/157 R |
| 3,681,960 | 8/1972 | Tadolioro | 29/157 R |
| 3,961,513 | 6/1976 | Stahly | 29/157.6 X |

*Primary Examiner*—Leon Gilden

*Attorney, Agent, or Firm*—Tilton, Fallon, Lungmus, Chestnut & Hill

[57] ABSTRACT

A method of making a pipe fitting havin three or more legs arranged in any desired shape by deforming a malleable metal tube substantially filled with a constant volume filler material in a single step without the need for secondary bending while maintaining the filler material at constant volume to provide a fitting wherein the variation in wall thickness is less than about 10%.

5 Claims, 4 Drawing Figures

METHOD OF MAKING A PIPE FITTING AND PRODUCT

BACKGROUND AND SUMMARY OF THE INVENTION

This invention relates to a method of making a pipe fitting and, more particularly, to a fitting having three or more legs arranged in any desired shape. It constitutes an improvement on U.S. Pat. No. 3,961,513 granted June 8, 1976.

Fittings of the type contemplated by the invention are used in a wide variety of fluid-conducting installations and, when the legs are curved, provide an extremely advantageous return bend connection for equipment using coils (either for heating or cooling).

Inasmuch as fittings (and the coils or other tubing to which they are attached) are of relatively small size — generally ranging in outside diameters from ⅜ inches to ½ inches, with diameter to wall thickness ratios of about 5 to 30 — it is important that the interior walls of the fittings be relatively smooth with the tubes having a fairly uniform inside diameter so as not to restrict fluid flow. Additionally, because these fittings are integrated into coil equipment and the like, as by brazing or other heat employing uniting operations, it is important that the fitting have high structural integrity so as to resist deformation which could result in resistance to fluid flow — or even premature rupture, resulting in extensive and expensive repair.

The invention herein is specifically directed to the making of a pipe fitting having three or more legs arranged in any desired manner from an elongated tube wherein the legs have a length to diameter ratio of more than 3 and where the ratio of diameter to wall thickness of the fitting is in the range of about 5 to 30. It will be appreciated that the provision of such a fitting requires extensive shifting of metal and the invention in the above identified patent sought to achieve this through the provision of a thicker wall adjacent the closed end of the starting tube or capsule. Although the invention of the above identified patent provides fittings characterized by a high degree of integrity, it has not provided fittings wherein the wall thickness is substantially uniform throughout the various branches of the fitting, i.e., less than about 10% variation. In fact, in some instances, the variation in wall thickness in products made according to the above identified patent ranges as high as 200%. Although the thicknesses per se are relatively small — of the order of 0.018–0.035 inches, the substantial variation does impede fluid flow and further makes difficult the union of the fitting into a piping system — it is difficult to braze different thickness walls together because the thicker wall element takes longer to heat and provides a "heat sink" effect.

The problems of the prior art have been solved through the employment of a constant volume filler material during the deformation of the elongated tube and maintaining the filler material at constant volume throughout the deformation. Additionally, I have found it advantageous to position the leg-forming cavities intermediate the length of the tube particularly where the fitting has fairly long legs to avoid shear planes, flow faults, or buildup. With the constant volume filler material, metal from both ends of the tube flows or feeds into the legs — thereby achieving a process akin to extrusion as contrasted to the "bulging" characteristic of the prior art procedures — as in U.S. Pat. No. 3,681,960.

Other objects and advantages of the invention may be seen in details of the ensuing specification.

DETAILED DESCRIPTION

The invention is described in conjunction with the accompanying drawing, in which FIG. 1 is a fragmentary, partially schematic elevational view, partially in section, of apparatus employed in the practice of the invention;

Figure 1:
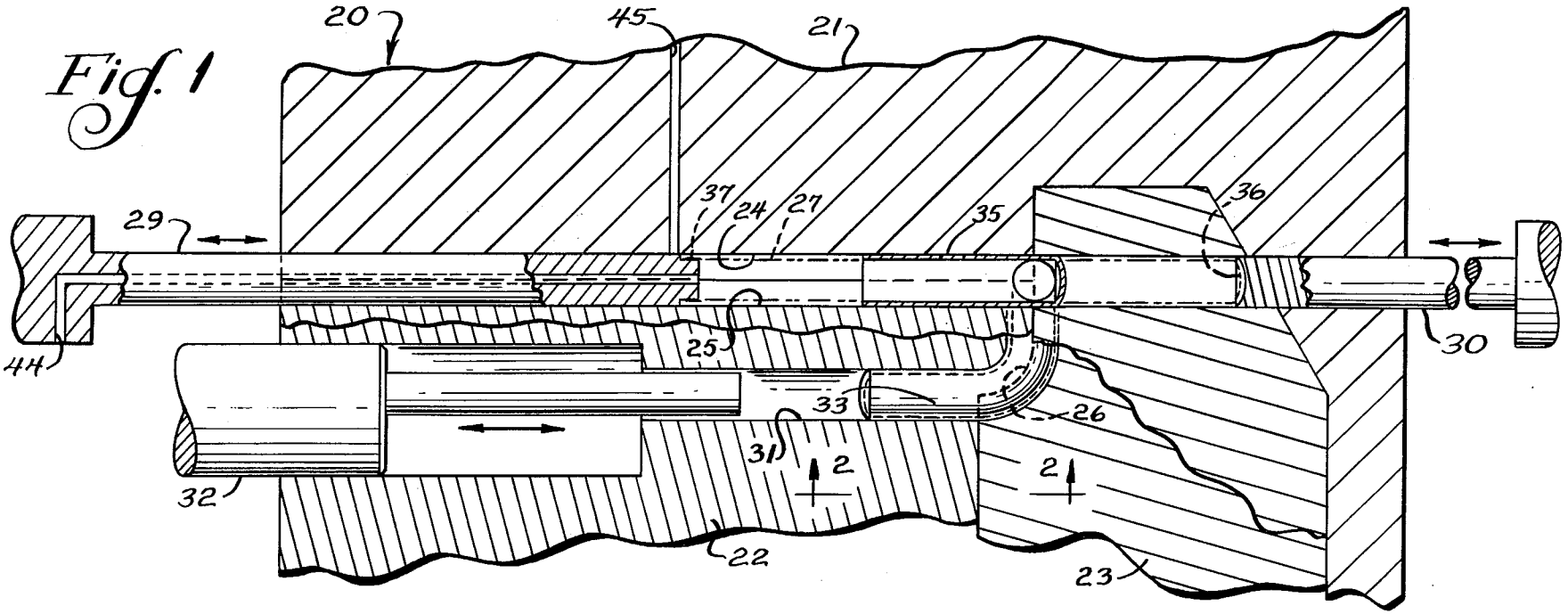

In the illustration given and with reference first to FIG. 1, the numeral 20 generally designates apparatus employed in the practice of the invention. The apparatus 20 includes a platform and framework (not shown) used to provide a mounting for an upper die 21, a lower die 22 and an insert die 23 as well as cylinder means (not shown) which are employed for raising and lowering the upper die 21 and camming means (not shown) used to provide a means for laterally moving the insert die 23. The upper die 21, the lower die 22, and the insert die 23 are equipped with grooves and recesses as at 24, 25 and 26, respectively, so as to receive a tube 27 (shown in phantom) to be deformed in a single step. With reference to the illustration of FIG. 1, the tube 27 is also illustrated in a fully deformed state which corresponds generally to the showing in FIGS. 2 and 3 designated by the numeral 28.

The apparatus 20 includes a pair of operably associated rams 29 and 30 which are mounted for movement toward and away from each other (as indicated by the arrows applied thereto) and which serve to deform the tube 27 into curved cavities such as 31 (only one of the cavities being shown). A knock-out 32 is provided in at least one of the curved cavities such as 31 for removing the completed fitting 28 from the grooves or recesses 24, 25 and 26 after the curved legs 33 and 34 and the straight leg 35 of the fitting 28 have been formed. In some instances, the development of the curved legs 33 and 34 may be restrained to equal development through the use of suitable pistons mounted in both of the curved cavities such as 31.

In the practice of the invention, a tube 27 is initially installed within the bore developed by the recesses 24 and 25. As detailed in the above-mentioned U.S. Pat. No. 3,961,513, the tube 27 may itself be provided from a solid blank or plug of malleable metal by cold working the same. Normally, these fittings are constructed of aluminum or copper as being suitable advantageous malleable metals. In any event, the tube 27 is characterized by having a closed end 36 and an open end 37.

Next, the tube 27 is substantially filled with a constant volume filler material. Excellent results have been obtained whether the material is solid or liquid at room temperatures, and if solid, a form of Woods metal is advantageous for this purpose — containing lead, tin and bismuth. Thereafter, the filled tube 27 is installed in the deformation apparatus 20 such as is schematically illustrated in phantom in FIG. 1.

Figure 2:
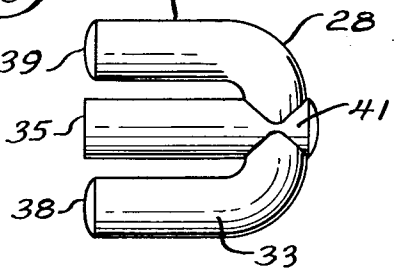
FIG. 2 is a sectional view taken on the line 2—2 of FIG. 1 with the apparatus removed illustrating a fitting produced according to the practice of the invention wherein two of the legs are curved.

The apparatus 20 shown in FIG. 1 is illustrated in the mode it employs when fashioning a fitting particularly wherein the legs have a substantial length, i.e., length to diameter ratio of 3 or more. The rams 29 and 30 are positioned so that the curved cavities such as 31 are located intermediate the length of the tube. The rams 29 and 30 then exert force on the tube 27 from both ends resulting in a deformation essentially like extrusion to develop the legs 33, 34 and 35 (as shown in FIG. 2). After the final configuration of FIG. 2 is reached, the fitting 28 is removed from the deforming apparatus 20 and the closed ends 38 and 39 of the curved legs 33 and 34, respectively, and transversely severed to provide the fitting 28 with three clear, open branches — as seen in FIG. 3.

Figure 3:
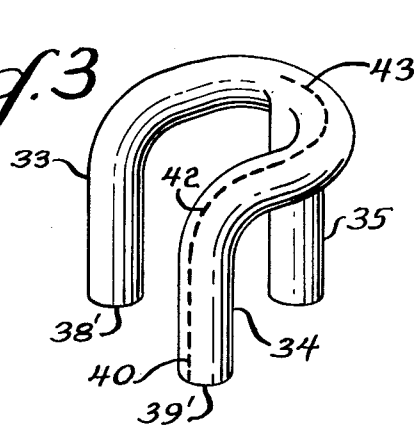
FIG. 3 is a perspective view of a tripod fitting made in accordance with the invention.

As seen in FIG. 3, the legs 33 and 34 are cylindrical or tubular in shape but unlike the tripod fittings made in accordance with the prior art, viz., U.S. Pat. No. 3,961,513, the axis of each of the legs 33 and 34 does not lie in a single plane. Rather the axis follows a curved path consisting of a straight portion 40 adjacent the open end 38' or 39' as the case may be. Thereafter, in proceeding toward the junction 41 (as shown in FIG. 2) the axis curves as at 42 but is still essentially in the same plane as that containing the axis portion 40. Still further, the axis in approaching the junction 41 curves inwardly as at 43 in the sense of approaching the other curved leg. Thus, I have provided a fitting made in but one step but which provides three open-ended legs arranged in a triangle, i.e., a tripod.

I prefer to employ the liquid filler material in the practice of the invention although it is possible to use other materials such as solids as the constant volume filler material. Solids have the advantage of requiring a less complicated apparatus since valving, flow passages, etc. are not necessary but liquids have the advantage of eliminating the step of melting the filler material to provide clear, open branches within the fitting. When liquid filler material is employed, the valving (not shown) is arranged to maintain the filler material at constant volume through a flow passage 44 in the ram 29 which can purge air through a vent 45 in the upper die 21.

Figure 4:
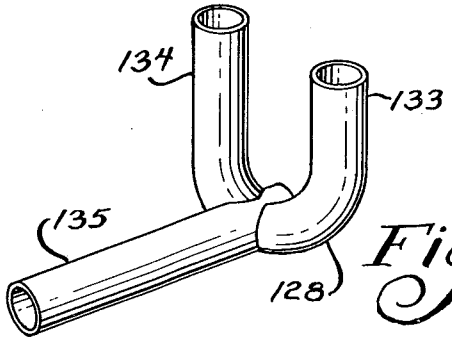
FIG. 4 is a perspective view illustrating a fitting produced according to the practice of the invention wherein two of the legs are curved differently through substitution of different dies from those seen in the apparatus of FIG. 1.

As indicated previously, the fitting 28 may be developed in th apparatus 20 of FIG. 1 with the legs 33 and 34 curved incident to deformation in the curved cavities such as 31 as illustrated by the showing in FIGS. 2 and 3. The cavities can also be curved differently (as having the axes coplanar) to form a fitting 128 as seen in FIG. 4, or they can be arranged in any other desired shape. With the fitting 128, the curved legs are designated 133 and 134 and the remaining leg or straight portion, which is designated 135, can be arched or curved in a conventional fashion to convert the configuration into a tripod fitting. Even though the extra bending step is required, there is still available the substantial benefits of the invention relative to achieving uniform wall thickness.

While in the foregoing specification a detailed description of the invention has been set down for the purpose of explanation, many variations in the details hereingiven may be made by those skilled in the art without departing from the spirit and scope of the invention.

I claim:

1. A method for producing a pipe fitting having at least three legs comprising the steps of:

providing a tube of malleable metal having one end closed and a diameter to wall thickness ratio in the range of 5–30, substantially filling said tube with a constant volume filler material, confining said tube in die means having relief zones on each side of said tube and intermediate the ends adapted to develop legs having a length to diameter ratio of more than 3, and deforming said tube in a single step by exerting pressure at both ends thereof to extrude the same from both ends simultaneously while continuously maintaining said filler material at constant volume to provide at least three legs thereby wherein the variation in wall thickness throughout said fitting is less than about 10%.

2. The method of claim 1 in which said filler material used in said filling step is liquid and thereafter maintaining said filler material at a constant volume during said deforming step.

3. The method of claim 1 in which at least two of said legs provided by said deforming step have closed ends and thereafter transversely severing said closed ends to provide at least three clear, open legs.

4. The method of claim 1 in which at least two of said legs provided by said deforming step are curved and said deforming step includes providing at least three legs in a generally tripod shape.

5. The method of claim 1 in which two of said legs have axes which include curved segments lying in different planes.

* * * * *